US006533688B1

(12) United States Patent
Huang

(10) Patent No.: US 6,533,688 B1
(45) Date of Patent: Mar. 18, 2003

(54) DART WITH ROTARY FLIGHT AND LIGHT MEANS

(76) Inventor: Kou-Hwa Huang, No. 38, Chang An Lu Street, Tai Ping City, Taichung (TW)

( * ) Notice: Subject to any disclaimer, the term of this patent is extended or adjusted under 35 U.S.C. 154(b) by 0 days.

(21) Appl. No.: 09/978,010

(22) Filed: Oct. 17, 2001

(51) Int. Cl.[7] ..... A63B 65/02
(52) U.S. Cl. ..... 473/578; 473/570
(58) Field of Search ..... 473/570, 578

(56) References Cited

U.S. PATENT DOCUMENTS 4,989,881 A * 2/1991 Gamble
5,058,900 A * 10/1991 Denen
5,425,542 A * 6/1995 Blackwood et al.

* cited by examiner

*Primary Examiner*—John A. Ricci
(74) *Attorney, Agent, or Firm*—Troxell Law Office PLLC

(57) ABSTRACT

A dart includes a barrel, a point movably supported on a spring member inside the barrel, a lighting circuit assembly mounted in the barrel, a fixed shaft element fixedly connected to the barrel opposite to the point, a rotary shaft element coupled to the fixed shaft element by a connector, and a flight fastened to a rotary shaft element outside the connector. The flight is rotated with the rotary shaft element relative to the fixed shaft element and the lighting circuit assembly is closed to emit light toward the flight when the dart thrown at the dartboard.

6 Claims, 5 Drawing Sheets

DART WITH ROTARY FLIGHT AND LIGHT MEANS

BACKGROUND OF THE INVENTION

The present invention relates darts and, more particularly, to a dart that rotates the flight and emits light when thrown at the dartboard.

A regular dart is generally comprised of a shaft, a flight connected to the rear end of the shaft, a barrel connected to the front end of the shaft, and a point axially extended from the front end of the barrel. This design of dart is functional, however it does not cause a visual effect when thrown at the dartboard.

SUMMARY OF THE INVENTION

It is one object of the present invention to provide a dart, which rotates the flight when thrown at the dartboard. It is another object of the present invention to provide a dart, which emits light when thrown at the dartboard. According to one aspect of the present invention, the dart is comprised of a barrel, a point mounted in the barrel and partially extended out of the front side of the barrel, a flight, and a shaft connected between the flight and the barrel. The shaft is comprised of a fixed shaft element fixedly fastened to the barrel, a rotary shaft element fixedly fastened to the flight, and a connector fixedly fastened to the fixed shaft element to secure the rotary shaft element to the fixed shaft element for enabling the flight to be rotated with the rotary shaft element relative to the fixed shaft element when the dart thrown at the dartboard. According to another aspect of the present invention, a lighting circuit assembly is installed in the barrel, and the point is axially slidably supported on a spring member in the barrel. When the dart thrown at the dartboard, the barrel is moved forwards into engagement with a rear shank of the point, causing the rear shank of the point to close the circuit of the lighting circuit assembly, and therefore the lighting circuit assembly is driven to emit light toward the flight.

DETAILED DESCRIPTION OF THE PREFERRED EMBODIMENT

Figure 1:
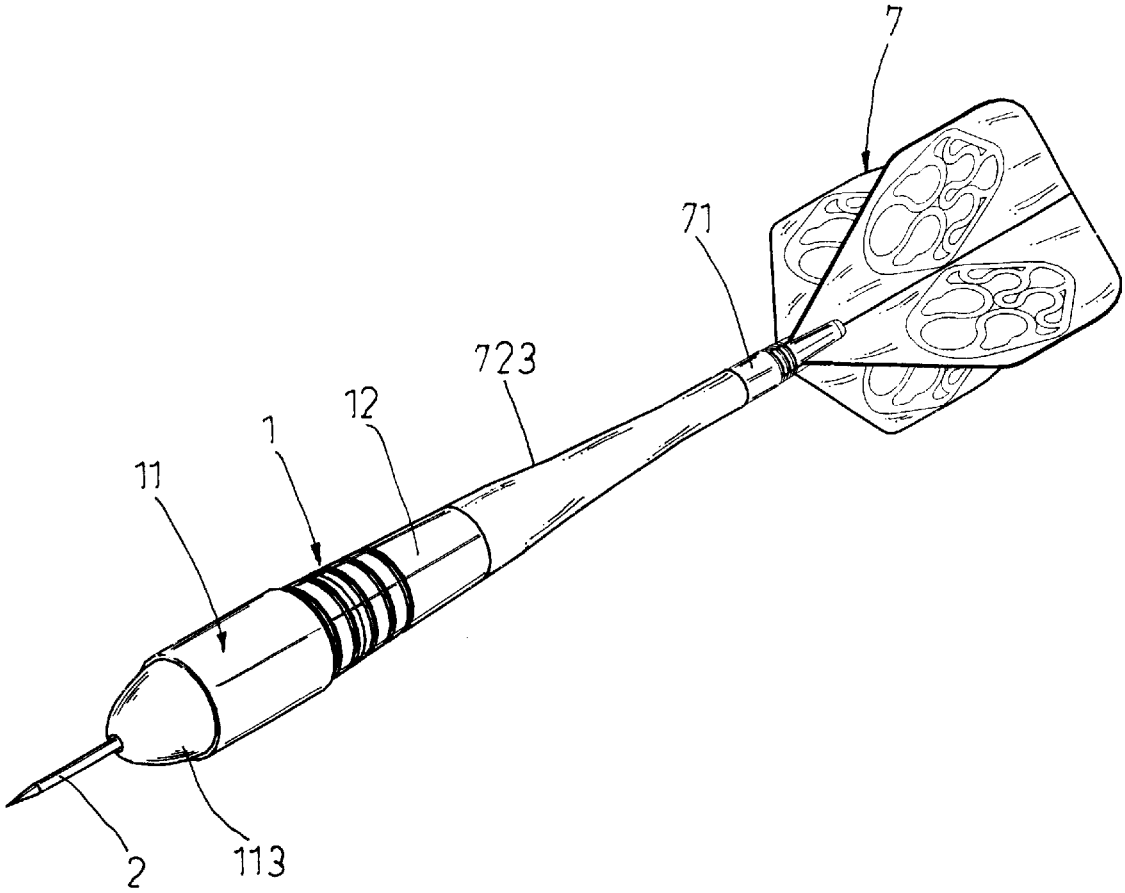
FIG. 1 is an elevational view of a dart constructed according to the present invention.
Figure 2:
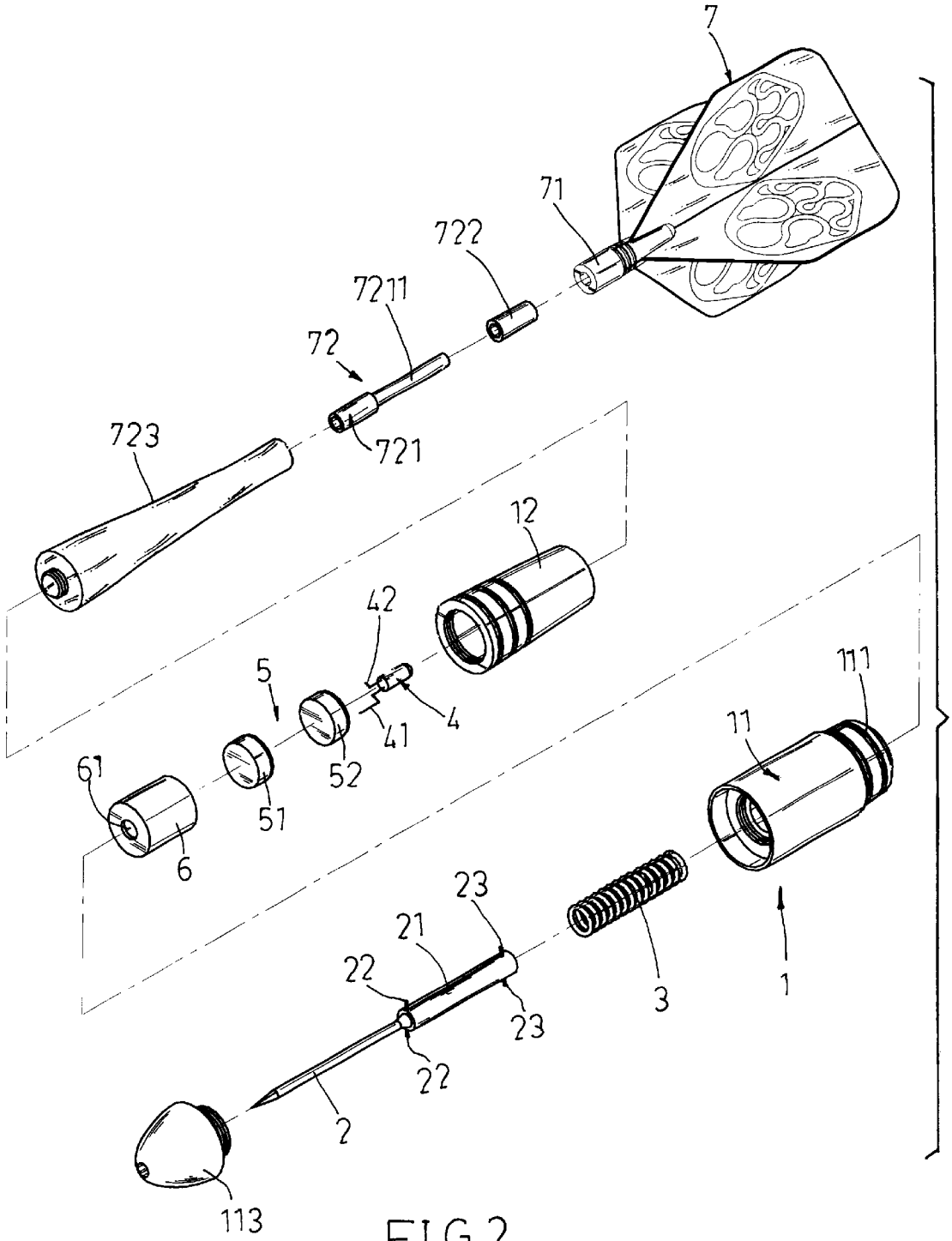
FIG. 2 is an exploded view of the dart according to the present invention.
Figure 3:
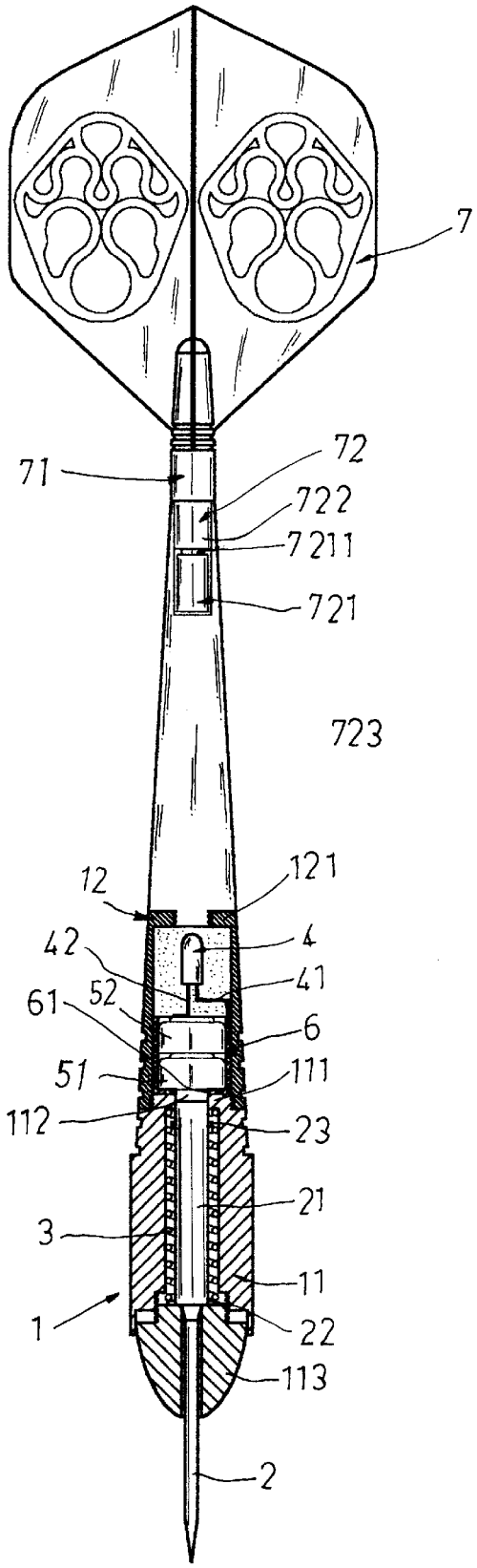
FIG. 3 is a sectional view of the dart according to the present invention.

Referring to FIGS. from 1 through 3, a dart in accordance with the present invention is generally comprised of a barrel 1, a point 2, a spring member 3, a LED (light emitting diode) 4, a battery set 5, an electrically insulative battery holder 6, a shaft 72, and a flight 7.

The barrel 1 is comprised of a front barrel element 11, a cone 113 fastened to the front end of the front barrel element 11 by a screw joint, and a rear barrel element 12 fastened to the rear end of the front barrel element 11 by a screw joint. The front barrel element 11, the cone 113, and the rear barrel element 12 are made of metallic material. The front barrel element 11 has an inwardly protruded annular rear flange 111 in the rear end. The annular rear flange 111 has a center through hole 112. The rear barrel element 12 has a screw hole 121 in the center of the rear close end thereof. The point 2 is axially slidably mounted in the barrel 1 and partially protruding over the front side of the front cone 113 (through the axially extended center through hole of the front cone) having a rear shank 21 of relatively greater diameter than the front end thereof. The rear shank 21 is suspended in the front barrel element 11 and partially inserted in the center through hole 112 of the annular rear flange 111 of the front barrel element 11, having front raised portions 22 and rear raised portions 23 respectively protruded from the periphery near the front and rear ends. The spring member 3 is sleeved onto the rear shank 21 of the point 2, having a front end stopped at the front raised portions 22 and a rear end supported on the annular rear flange 111 of the front barrel element 11. The spring member 3 imparts a forward pressure to the point 2, holding the point 2 in the front limit position. When the point 2 pushed backwards (inwards), the rear raised portions 23 are stopped at the annular rear flange 111 of the front barrel element 11, keeping the point 2 in the rear limit position. The electrically insulative battery holder 6 is mounted in the rear barrel element 12, having a front center hole 61 connected to the center through hole 112 of the annular rear flange 111 of the front barrel element 11. The battery set 5 is comprised of a first battery cell 51 and a second battery cell 52 connected in series and mounted in the electrically insulative barrel holder 6. The LED 4 is fixedly fastened to the inside of the rear barrel element 12 by transparent glue and aimed at the screw hole 121, having a positive pole lead-out leg 41 connected to the inside wall of the rear barrel element 12 and a negative pole lead-out leg 42 disposed in contact with the negative terminal of the second battery cell 52. The flight 7 is made of light penetrable material and marked with a design, having a front neck 71 coupled to the shaft 72. The shaft 72 couples the flight 7 to the barrel 1, and is comprised of a fixed shaft element 723, a rotary shaft element 721, and a connector 722. The fixed shaft element 723, the rotary shaft element 721, and the connector 722 are made of light penetrable material. The fixed shaft element 723 is a tapered hollow cylinder having a threaded front neck threaded into the screw hole 121 of the rear barrel element 12. The connector 722 is a tubular element fixedly fastened to the rear end of the fixed shaft element 723. The rotary shaft element 721 is inserted into the inside of the fixed shaft element 723 and stopped at the front side of the connector 722 for free rotation, having a rear extension rod 7211 inserted through the connector 722 and fixedly connected to the front neck 71 of the flight 7 for enabling the flight 7 to be rotated with the rotary shaft element 721 relative to the fixed shaft element 723 and the connector 722.

Figure 4:
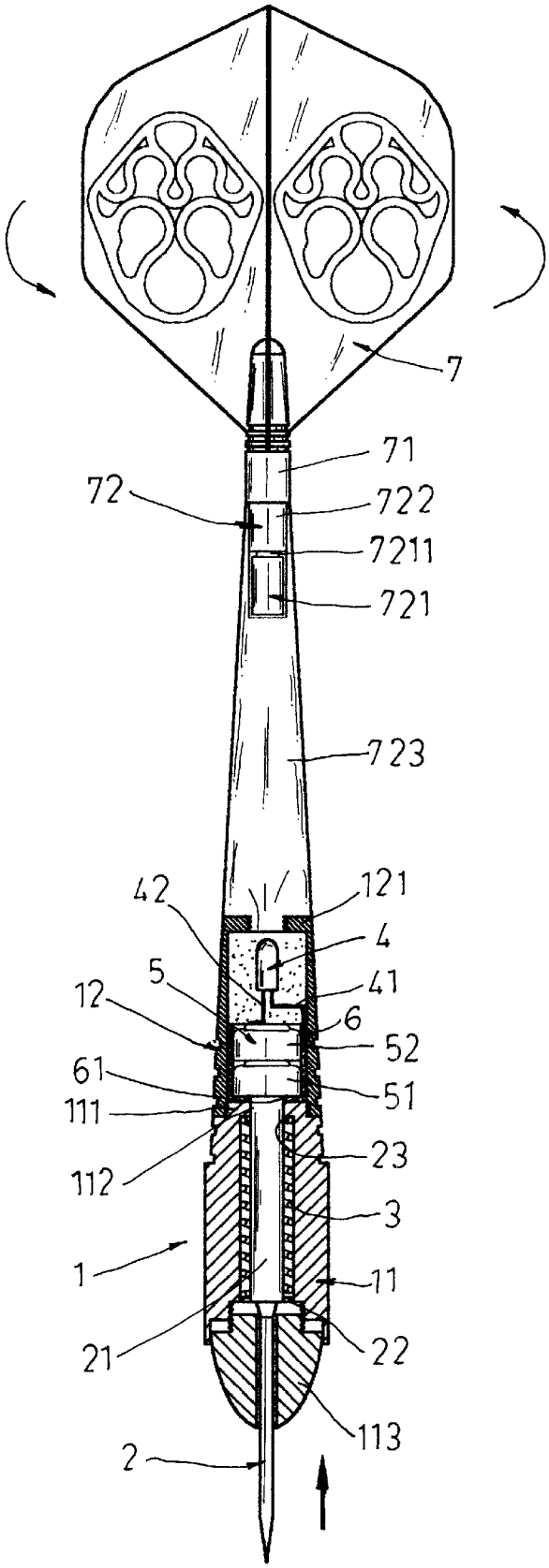
FIG. 4 is a schematic drawing showing the dart in action.

Referring to FIG. 4, when thrown the dart at the dartboard (not shown), the barrel 1 and the shaft 72 are forced forwards relative to the pint 2 due to inertia effect, thereby causing the rear shank 21 of the point 2 to contact the positive terminal of the first battery cell 51. When the rear shank 21 of the point 2 touched the positive terminal of the first battery cell 51, the circuit of the battery set 5, the LED 4, and the barrel 1 is closed, causing the LED 4 to emit light through the shaft 72 and the flight 7. At the same time, the flight 7 is forced to rotate with the rotary shaft element 721 relative to the fixed shaft element 723.

Figure 5:
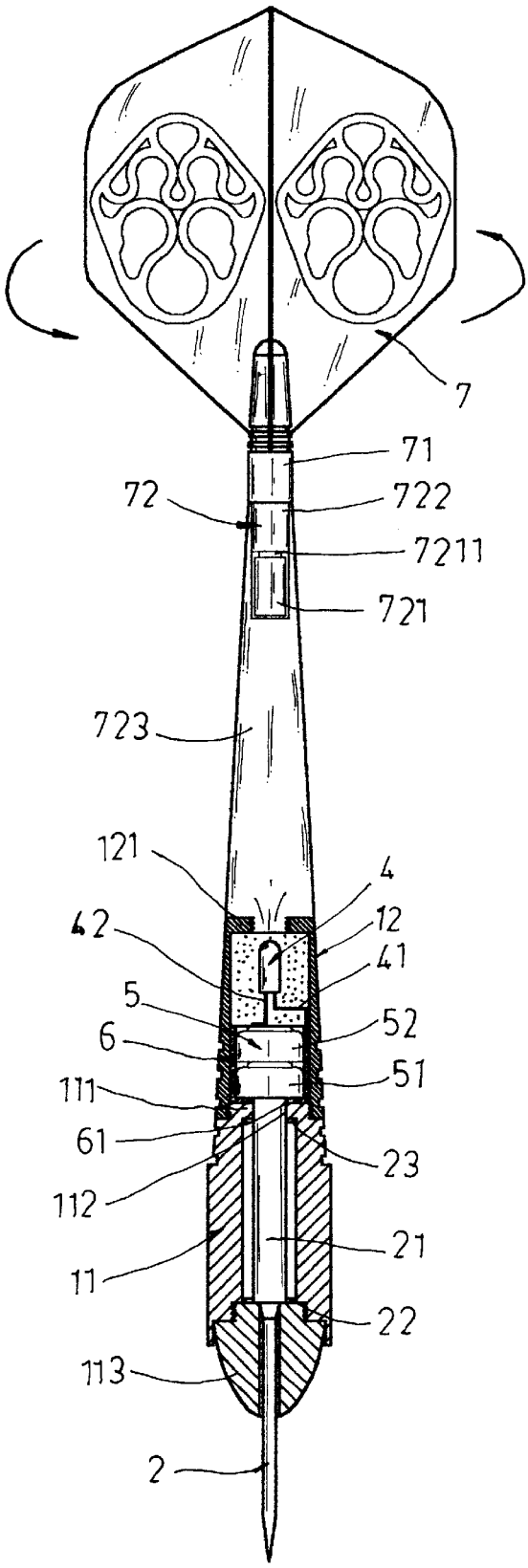
FIG. 5 is a sectional view of an alternate form of the dart according to the present invention.

FIG. 5 shows an alternate form of the present invention. According to this alternate form, the aforesaid spring member 3 is eliminated, and the point 2 is fixedly fastened to the center through hole 112 of the annular rear flange 111 of the front barrel element 11, keeping the rear shank 21 constantly in contact with the positive terminal of the first battery cell 51. Preferably, the front cone 113 is adjustably connected to the front barrel element 11 between two positions, namely, the first position where the rear shank 21 is maintained in contact with the positive terminal of the first battery cell 51, and the second position where the rear shank 21 is disconnected from the positive terminal of the first battery cell 51.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A dart comprising:

a barrel, said barrel having a front side and a rear side;

a metal point axially slidably mounted in said barrel and partially protruding over the front side of said barrel;

a shaft connected to the rear side of said barrel;

a flight coupled to said shaft remote from said barrel; and a lighting circuit assembly installed in said barrel and adapted to emit light toward said shaft and said flight;

wherein said shaft comprises a fixed hollow shaft element made of light penetrable material, said fixed hollow shaft element having a front side fastened to the rear side of said barrel and a rear side opened, a rotary shaft element made of light penetrable material and inserted into the rear side of said fixed shaft element for free rotation, said rotary shaft element having a rear extension rod extended out of the rear side of said fixed shaft element, and a connector made of light penetrable material and sleeved onto the rear extension rod of said rotary shaft element and fixedly fastened to the rear side of said fixed shaft element to stop said rotary shaft element from falling out of said fixed shaft element; said flight is made of light penetrable material, having a front neck fixedly fastened to the rear extension rod of said rotary shaft element outside said fixed shaft element for free rotation with said rotary shaft element relative to said fixed shaft element.

2. The dart as claimed in claim 1 wherein said barrel comprises a metal front barrel element having a front side and a rear side, a metal rear barrel element connected between the rear side of said front barrel element and the front side of said fixed shaft element, said rear barrel element having an inwardly protruded rear annular flange, said rear annular flange defining a center through hole, and a metal front cone connected to the front side of said front barrel element.

3. The dart as claimed in claim 2 wherein said lighting circuit assembly comprises an electrically insulative battery holder mounted inside said rear barrel element, said battery holder having a front center hole connected to the center through hole of the rear annular flange of said front barrel element, a light emitting diode embedded in a transparent glue in said rear barrel element outside said battery holder, said light emitting diode having a positive pole lead out leg connected to an inside wall of said rear barrel element and a negative pole lead out leg, and a battery set mounted in said battery holder, said battery set having a negative terminal disposed in contact with the negative pole lead out leg of said light emitting diode and a positive terminal facing the center through hole of said battery holder for the contact of said point to turn on said light emitting diode when the dart thrown at a dartboard to force said point backwards relative to said barrel.

4. The dart as claimed in claim 3 wherein said point comprises a rear shank of relatively greater diameter than a front end thereof suspended in said front barrel element and partially inserted in the center through hole of the annular rear flange of said front barrel element, said rear shank having front raised portions and rear raised portions respectively protruded from the periphery near front and rear ends thereof and adapted to limit axial movement of said point relative to said barrel.

5. The dart as claimed in claim 4 wherein said front cone is fastened to the front side of said front barrel element by a screw joint and rotated relative to said front barrel element between a first position where said point is disconnected from the negative terminal of said battery set, and a rear position where the rear shank of said point is forced through the front center hole of said battery holder into contact with the negative terminal of said battery set.

6. The dart as claimed in claim 4 further comprising a spring member sleeved onto the rear shank of said point and adapted to impart a forward pressure to said point, said spring member having a rear side supported on the annular rear flange of said front barrel element and a front side stopped at the front raised portions of said rear shank.

* * * * *